US006694575B1

(12) United States Patent
Martin

(10) Patent No.: US 6,694,575 B1
(45) Date of Patent: Feb. 24, 2004

(54) SPORTS GLOVE HOLDER

(76) Inventor: Richard M. Martin, 23 Highland Cir., The Woodlands, TX (US) 77381-3886

( * ) Notice: Subject to any disclaimer, the term of this patent is extended or adjusted under 35 U.S.C. 154(b) by 0 days.

(21) Appl. No.: 10/274,231

(22) Filed: Oct. 21, 2002

(51) Int. Cl.[7] ..... A44B 18/00; A44B 11/25; A45F 5/02; B65B 15/00

(52) U.S. Cl. ..... 24/306; 24/3.1; 24/163 K; 24/303; 24/442; 24/904; 206/315.3; 224/222; 224/250

(58) Field of Search ..... 24/306, 442, 443, 24/444, 904, 304, 303, 3.1; 224/222, 250; 206/315.3; 2/319, 338

(56) References Cited

U.S. PATENT DOCUMENTS

| | | | | | |
|---|---|---|---|---|---|
| ,636,149 | A | * | 10/1899 | Kimsey | 24/3.1 |
| 3,251,109 | A | * | 5/1966 | Wilson et al. | 24/306 |
| 4,625,862 | A | * | 12/1986 | Clayton | 206/315.3 |
| 4,715,839 | A | * | 12/1987 | Ford et al. | 24/163 K |
| 4,779,312 | A | * | 10/1988 | Carlson | 24/304 |
| 4,821,933 | A | | 4/1989 | Seber | |
| 4,863,084 | A | * | 9/1989 | Nabozny | 224/253 |
| 5,143,371 | A | | 9/1992 | Strahan | |
| 5,177,881 | A | * | 1/1993 | Moore | 34/239 |
| 5,186,373 | A | | 2/1993 | Taylor | |
| 5,237,988 | A | * | 8/1993 | McNeese | 24/306 |
| D349,810 | S | | 8/1994 | Rutledge | |
| 5,864,925 | A | | 2/1999 | McGee | |
| D409,379 | S | | 5/1999 | Ellis | |
| 6,131,249 | A | * | 10/2000 | Suenaga | 24/306 |
| D433,229 | S | | 11/2000 | Harker et al. | |
| D458,756 | S | | 6/2002 | Smith | |

* cited by examiner

*Primary Examiner*—Victor Sakran
(74) *Attorney, Agent, or Firm*—Litman Law Offices, Ltd.

(57) ABSTRACT

A sports glove holder for allowing a glove to be attached comfortably and securely to the belt of a player. The sports glove holder has loops for attaching the holder to the belt of the player. A hook and loop fastener allows the glove to be removably attached to the holder. The hook and loop fastener is attached to a machine-pressed indent in the main body using a material specific adhesive. This allows the device to withstand the repetitive removal of the glove without fear of the hook and loop fastener coming loose. The sports glove holder can be color coordinated with the uniform or outfit worn by the player.

6 Claims, 3 Drawing Sheets

SPORTS GLOVE HOLDER

BACKGROUND OF THE INVENTION

1. Field of the Invention

The present invention relates to glove holders and more particularly to a sports glove holder that is worn on the belt and holds the glove in place. The holder utilizes a hook and loop fastener.

2. Description of the Related Art

When playing certain sports, gloves are worn by the players. Baseball, football and golf are some of the sports where a glove is worn. After a play, the player may wish to remove the glove. This can be a problem since a pocket or an assistant is not always available. The player desires to have the glove close by and ready before the next play begins.

The prior art teaches several ways to solve this problem. U.S. Pat. No. D349,810 to Rutledge, U.S. Pat. No. D409,379 to Ellis, U.S. Pat. No. D458,756 to Smith, U.S. Pat. No. 5,143,371 to Strahan, U.S. Pat. No. 5,186,373 to Taylor and U.S. Pat. No. 5,864,925 to McGee appear to be bulky and have multiple moving parts. U.S. Pat. Nos. D433,229 and 4,821,933 are drawn to belt worn tool holders.

None of the above inventions and patents, taken either singularly or in combination, is seen to describe the instant invention as claimed. Thus, a sports glove holder solving the aforementioned problems is desired.

SUMMARY OF THE INVENTION

The present invention is a sports glove holder that has a planar body that has a machine pressed indent that holds a hook and loop fastener to securely hold the glove. The sports glove holder has belt loops to hold the device in place snugly to the belt of the player. The sports holder device can be color coordinated with the color of the outfit worn by the player.

Accordingly, it is a principal object of the invention to design a sports glove holder that is simple in design and easy to use.

It is another object of the invention to have a sports glove holder that fits securely and comfortably on the belt.

It is a further object of the invention to create a device that holds the glove securely without worry of the glove being lost or in the way of the player.

Still another object of the invention is to provide a sports glove holder that can be color coordinated with the outfit worn by the player.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
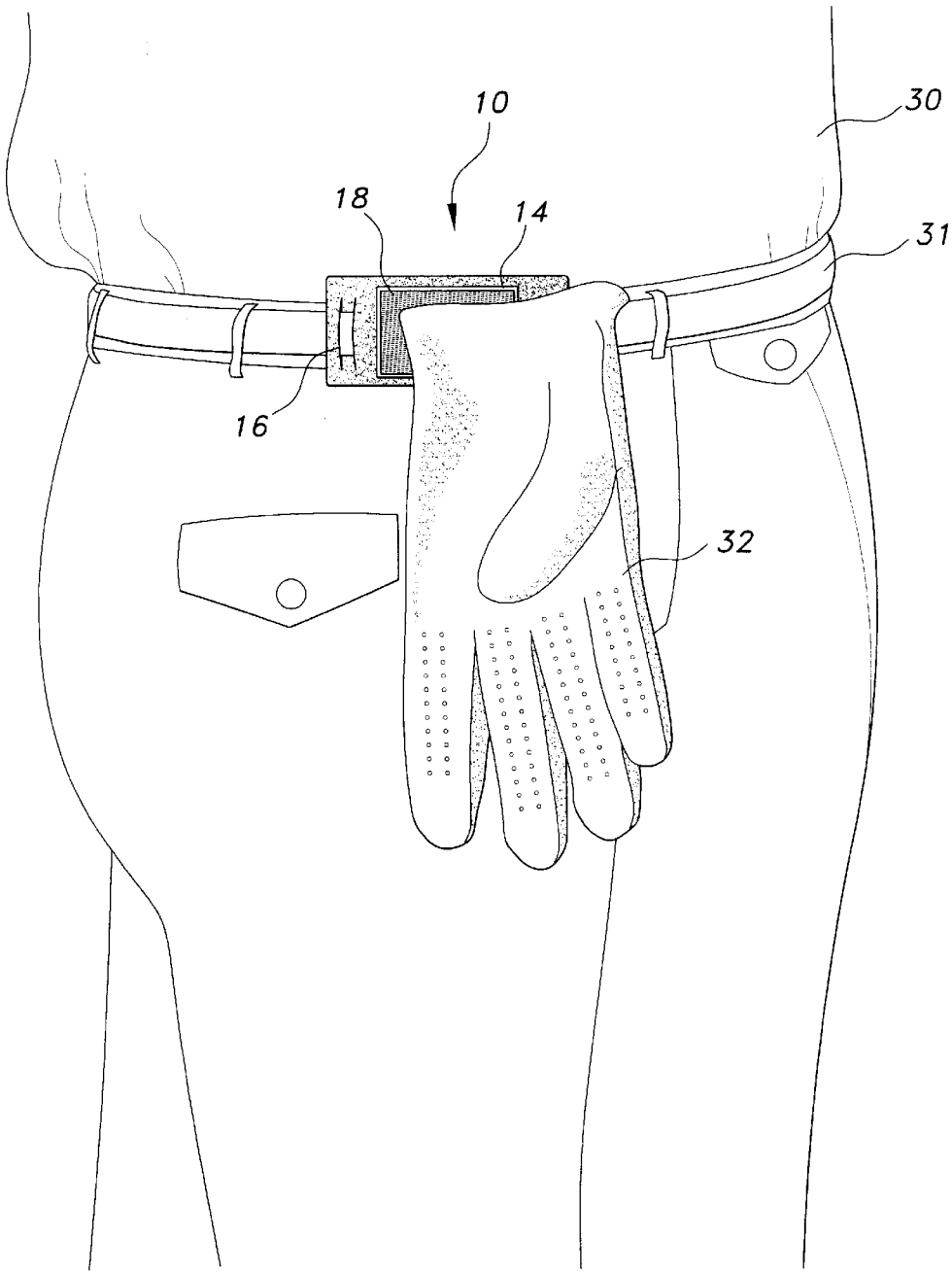
FIG. 1 is an environmental, perspective view of a sports glove holder according to the present invention.

The present invention is a sports glove holder 10 that removably holds a glove 32 such as a golf glove until needed. The sports glove holder 10 has an elongated generally planar body 12 that has a recessed detent 14 that can be machine-made. The elongated generally planar body 12 is preferably made of leather, although any material can be utilized. The elongated generally planar body 12 of the sports glove holder 10 can be colored to match the colors of the player's 30 outfit or uniform. The detent 14 holds a hook and loop fastener 18 that has a layer 20 of material specific adhesive. The layer 20 of adhesive securely bonds the hook and loop fastener 18 within the detent 14 to withstand multiple removals of the glove 32 from the sports glove holder 10. The detent 14 and the hook and loop fastener 18 are centered on the elongated generally planar body 12.

Figure 2:
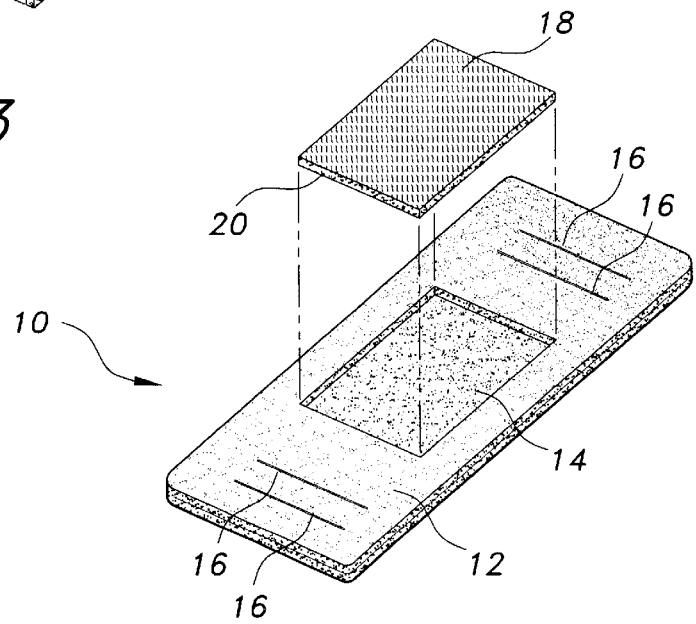
FIG. 2 is an exploded view of a sports glove holder.

The elongated generally planar body 12 has at least a pair of slits 16 on each side of the hook and loop fastener 18 that allow the sports glove holder 10 to be held snugly on the belt 31 as shown in FIG. 2. Each pair of slits 16 create a belt loop through which the belt 31 of the player 30 is inserted. This arrangement allows the sports glove holder 10 to lay close to the body of the player 30. This allows the player, i.e., a golfer 30, to be able to reach the glove 32 without having to fumble. This also allows the glove 32 to maintain it's shape since it will not be placed into a pocket or a bag.

Figure 3:
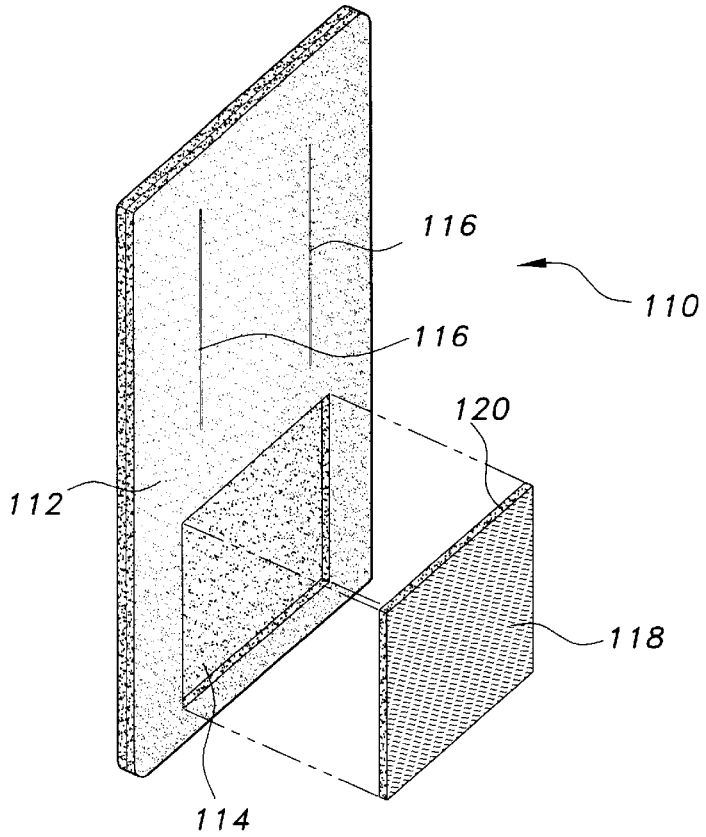
FIG. 3 is an exploded view of a second embodiment of the invention.
Figure 4:
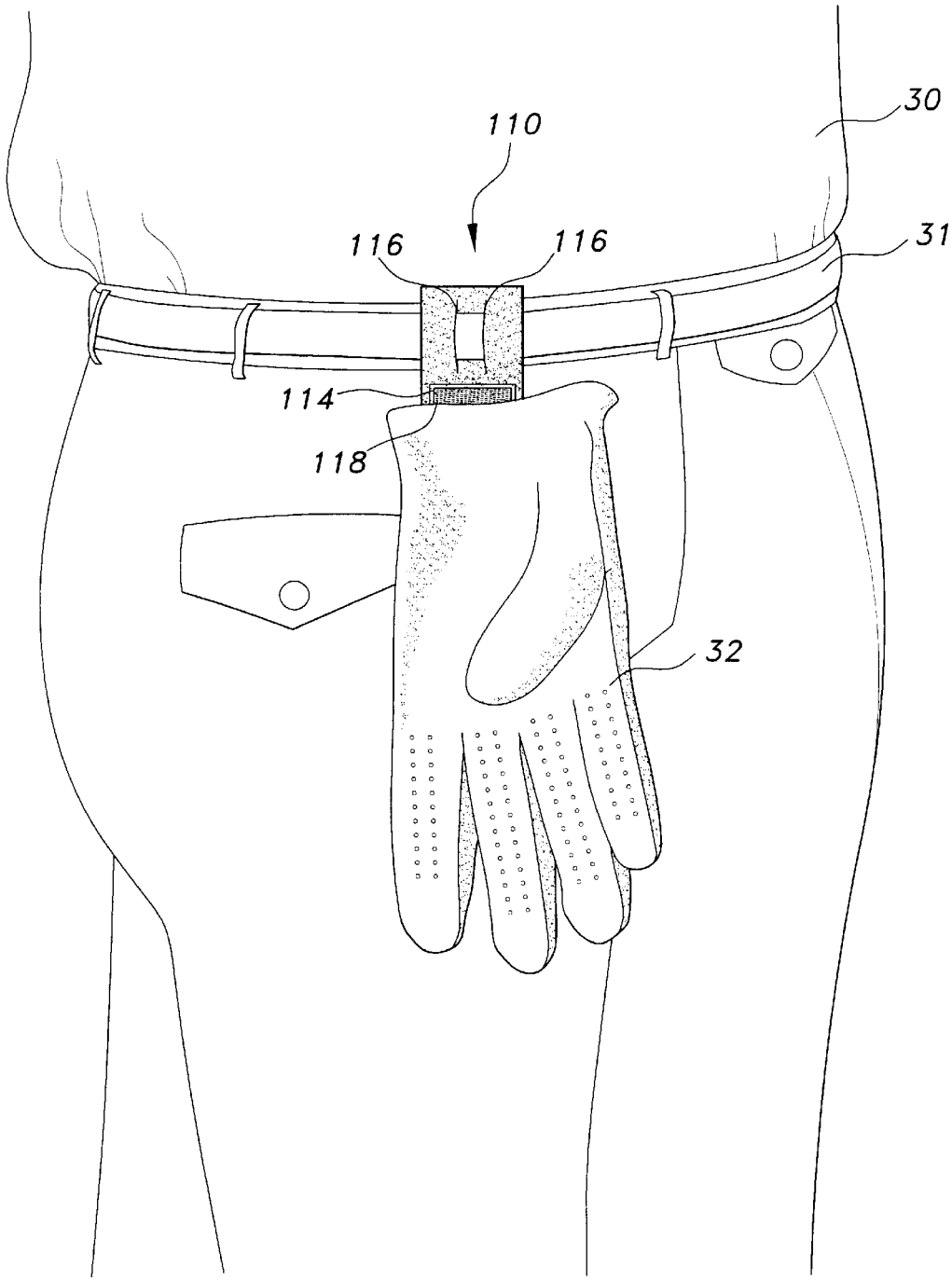
FIG. 4 is an environmental view of the second embodiment of the sports glove holder.

FIGS. 3 and 4 show a second embodiment of the sports glove holder 110. The sports glove holder 110 has an elongated, generally planar body 112 having a detent 114 in which a hook and loop fastener 118 is mounted utilizing a layer 120 material specific adhesive. In this embodiment, the detent 114 and hook and loop fastener 118 are located toward one end of the elongated generally planar body 112. A pair of slits 116 extending longitudinally are located toward the other end of the elongated generally planar body 112. The pair of slits 116 create a loop through which the belt 31 is inserted. This arrangement allows hook and loop fastener 118 to hang below the belt 31 when the sports glove holder 110 is position as shown in FIG. 4.

It is to be understood that the present invention is not limited to the embodiments described above, but encompasses any and all embodiments within the scope of the following claims.

I claim:

1. A sports glove holder for removably holding a glove onto a belt of a player comprising:

an elongated, generally planar main body having a recessed detent;

a hook and loop fastener having a layer of adhesive on one side thereof, said hook and loop fastener held onto the main body within the detent; and at least one pair of slits, each of said slits forming a belt loop that is attachable to the belt of a player;

wherein said detent and said hook and loop fastener are centered on said elongated, generally planar main body; and wherein at least one slit of said at least one pair of slits is disposed on each side of said detent and said hook and loop fastener to hold said sports glove holder onto the belt of the player.

2. The sports glove holder of claim 1 wherein, said elongated, generally planar main body is made of leather.

3. The sports glove holder of claim 1 wherein, said elongated, generally planar main body is colored to coordinate with the uniform or outfit of the player.

4. A sports glove holder for removably holding a glove onto a belt of a player comprising:

an elongated, generally planar main body having a first end, a second end and a recessed detent;

a hook and loop fastener having a layer of adhesive on one side thereof, said hook and loop fastener held onto the main body within the detent; and at least one pair of slits, each of said slits forming a belt loop that is attachable to the belt of a player;

wherein said detent and said hook and loop fastener are disposed into said first end of said elongated, generally planar main body; and wherein said at least one pair of slits is disposed in said second end of said elongated, generally planar body allowing the sports glove holder to hang from the belt of the player.

5. The sports glove holder of claim 4 wherein, said elongated, generally planar main body is made of leather.

6. The sports glove holder of claim 4 wherein, said elongated, generally planar main body is colored to coordinate with the uniform or outfit of the player.

* * * * *